US005855143A

United States Patent [19]

Ewing

[11] Patent Number: 5,855,143

[45] Date of Patent: Jan. 5, 1999

[54] ADJUSTABLE PEDAL APPARATUS

[75] Inventor: Kip Alan Ewing, Dearborn, Mich.

[73] Assignee: Ford Global Technologies, Inc., Dearborn, Mich.

[21] Appl. No.: 977,697

[22] Filed: Nov. 25, 1997

[51] Int. Cl.[6] ..... G05G 1/14

[52] U.S. Cl. ..... 74/512

[58] Field of Search ..... 74/512, 513, 514, 74/560

[56] References Cited

U.S. PATENT DOCUMENTS 3,828,625 8/1974 Bruhn, Jr. ..... 74/512

4,497,399 2/1985 Kopich ..... 74/512 X

*Primary Examiner*—Charles A. Marmor

*Assistant Examiner*—Mary Ann Battista

*Attorney, Agent, or Firm*—Gregory P. Brown

[57] ABSTRACT

An adjustable pedal apparatus allows the adjustment of a first end of a pedal lever (18) to accommodate operators having varying anatomical characteristics. The apparatus includes an adjuster link (28) having a first end pivotally connected to a second end of the pedal lever and a first end pivotally connected to a first ground point (32). A bell crank (38) is pivotally connected to a second ground point at one end and a push rod (48) at the opposite end. A drag link (54) interconnects the bell crank between its ends and the pedal lever (18) between its ends. The interconnection of the adjuster link the pedal lever form a virtual ground point (58) so as to form an adjustable ground link with the second ground point. The adjustable ground link allows the first end of the pedal lever (18) to be adjusted between first and second pedal positions.

7 Claims, 3 Drawing Sheets

ADJUSTABLE PEDAL APPARATUS

BACKGROUND OF THE INVENTION

1. Field of the Invention

The present invention relates generally to control devices for motor vehicles. More particularly the apparatus is useful for providing an adjustable pedal position to accommodate various vehicle operators.

2. Disclosure Information

In the conventional motor vehicle, pedals are provided for controlling the brakes and engine throttle.

If the vehicle has a manual transmission, then a clutch pedal may also be provided. These pedal controls are operated by the vehicle operator. In order for the vehicle operator to obtain the most advantageous position for working these controls, the vehicle's front seat is usually slidably mounted on a seat track with means for retaining the seat along the track in a number of set positions.

The adjustment provided by moving the seat along the seat track does not accommodate all vehicle operators due to obvious differences in anatomical dimensions. It has therefore been recognized that it would be desirable to provide pedals that are adjustable so as to increase the comfort of the vehicle operator. For instance, U.S. Pat. No. 3,400,607, assigned to the same Assignee as the present invention, provides a vehicle control assembly for providing pedal adjustments. Previous adjustable pedal assemblies shared common shortcomings preventing their wide commercial success. Generally the designs were costly, very complex to manufacture and assemble and inconsistent in function throughout their range of adjustment. Specifically, the function attributes include providing a constant motion ratio through the full range of pedal adjustment, which is desirable for maintaining the desired actuation efforts. Additionally, previous adjustable pedal assemblies did not provide consistent ergonomic pedal travel throughout the range of adjustment.

It would be desirable to overcome the aforenoted difficulties with previous adjustable pedal assemblies for use in motor vehicles by providing a simple, low cost apparatus for adjusting the pedal location and providing all operators of various anatomical dimensions preferred pedal efforts and ergonomic pedal travel for operation of the motor vehicle.

SUMMARY OF THE INVENTION

Therefore, the present invention provides an improvement over conventional vehicles by providing an adjustable pedal control that is moveably mounted so that the operator may select an appropriate spacing between the seat and the pedals commensurate with the length of the operators legs.

In accordance with the present invention, an adjustable pedal apparatus for actuating a device within a vehicle includes a pedal lever having a first end and an adjuster link having a first end pivotally connected to a second end of the pedal lever. A second end of the adjuster link is pivotally connected to a first ground point. A bell crank is provided having a first end pivotally connected to a second ground point and a second end pivotally connected to a first end of a push rod. A second end of the push rod is attached to the device intended to be actuated by the vehicle operator. The pedal assembly also includes a drag link with a first end pivotally connected to the bell crank between its first and second ends and a second end pivotally connected to the pedal lever between its first and second ends.

Together, the first end of the adjuster link and the second end of the pedal lever form a virtual ground point so as to form an adjustable ground link with the second ground point. Adjustment of the adjuster link relative to the first ground point between a first position and a second position causes the first end of the pedal lever to adjust between corresponding first and second pedal positions.

It is an advantage of the present invention to provide a simple, low cost adjustable pedal apparatus capable of providing, throughout its range of adjustment, consistent pedal efforts and ergonomic pedal travel for operation of the motor vehicle.

DETAILED DESCRIPTION OF THE PREFERRED EMBODIMENT

Figure 1:
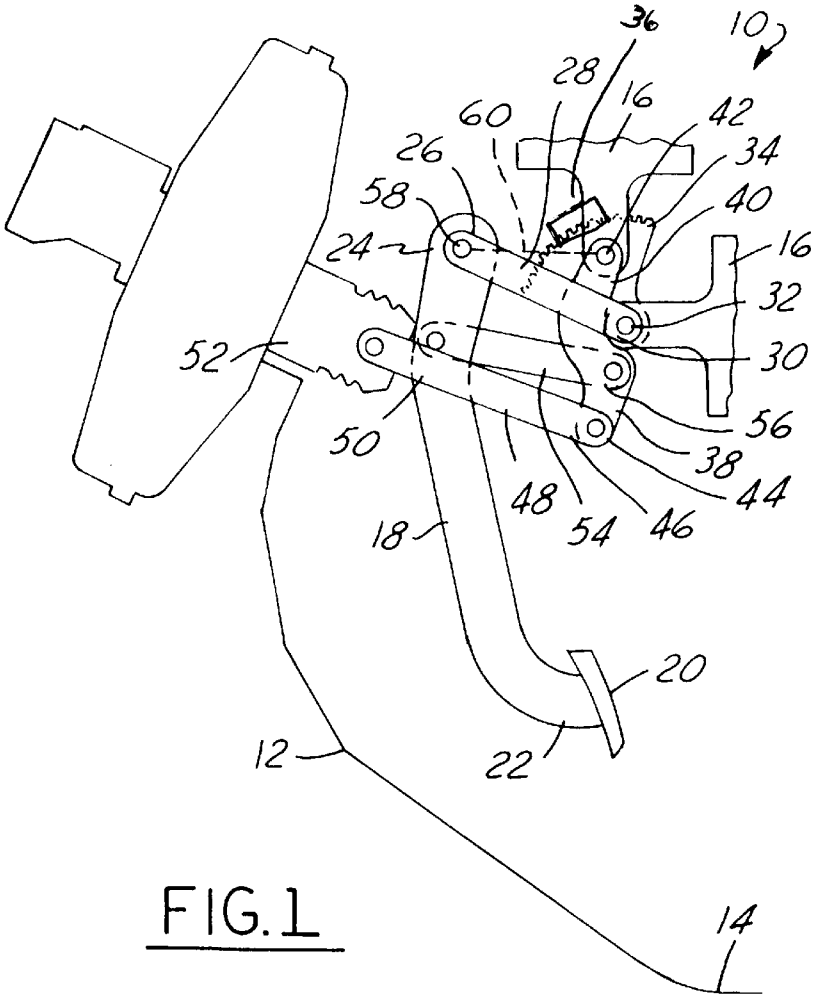
FIG. 1 is a side elevational view of an adjustable pedal mechanism for a motor vehicle constructed in accordance with the present invention.

Referring now to FIG. 1, the adjustable pedal assembly 10 is shown installed in a motor vehicle. The vehicle includes a dash panel 12, which extends downward to a portion of a floor member 14, and a pedal support structure 16, which may be constructed from crossbars integrated with an instrument panel and steering column support structure.

A pedal lever 18 includes a pad 20 at its first end 22 and a second end 24 that is pivotally connected a first end 26 of an adjuster link 28. A second end 30 of the adjuster link 28 is pivotally connected to a first ground point 32 which depends from the stationary pedal support structure 16.

An adjuster mechanism, illustrated here by a sector gear 34, drivingly engaged with an electric motor driven worm gear 36, provides for infinitely adjusting the position of the adjuster link 28 relative to the first ground point 32 between two positions defined by the ends of the sector gear. In the illustrated embodiment, the gear ratio of the sector gear and the worm gear are sufficient to prevent unintended movement of the sector gear during operation. It should be recognized by those skilled in the art that the adjuster mechanism may comprise one of many known devices, including driving the worm gear via a remote motor and cable, or with a manual mechanism requiring the displacement of a cable through actuation of a lever or knob.

A bell crank 38 includes a first end 40 pivotally connected to a second ground point 42 which depends from the stationary pedal support structure 16. The bell crank extends downward, in a slightly parallel relationship with the pedal lever 18 to a second end 44 where it pivotally connects to a first end 46 of a push rod 48. A second end 50 of the push rod 48 is pivotally connected to a device for which the pedal assembly is intended actuate, which, as shown in the present illustration, may include a brake master cylinder 52.

A drag link 54 includes a first end 56 pivotally connected to the bell crank at a position between the first and second ends of the bell crank. The drag link 54 extends from the bell crank to a second end which is pivotally connected to the pedal lever at a position between the first and second ends of the pedal lever.

For any adjusted position of the adjuster link 28, a unique virtual ground point 58 is formed by the connection of the first end of the adjuster link and the second end of the pedal lever. In turn, the virtual ground point together with the second ground point 42 create an adjustable ground link 60, which, in combination with the pedal lever, drag link and bell crank, makes up a parallelogram, or four bar mechanism for translating a displacement and force applied to the first end of the pedal lever to the second end of the push rod.

Operation of the adjustable pedal will now be described. FIG. 1 illustrates the pedal assembly in an released position, that is, with no force being applied by an operator. Further, the pedal is adjusted to its first or forward most position, to accommodate operators having longer legs, thus requiring greater space between a seat and the pedal assembly. The pedals may also be put in this position to facilitate ingress and egress of the operator.

Figure 2:
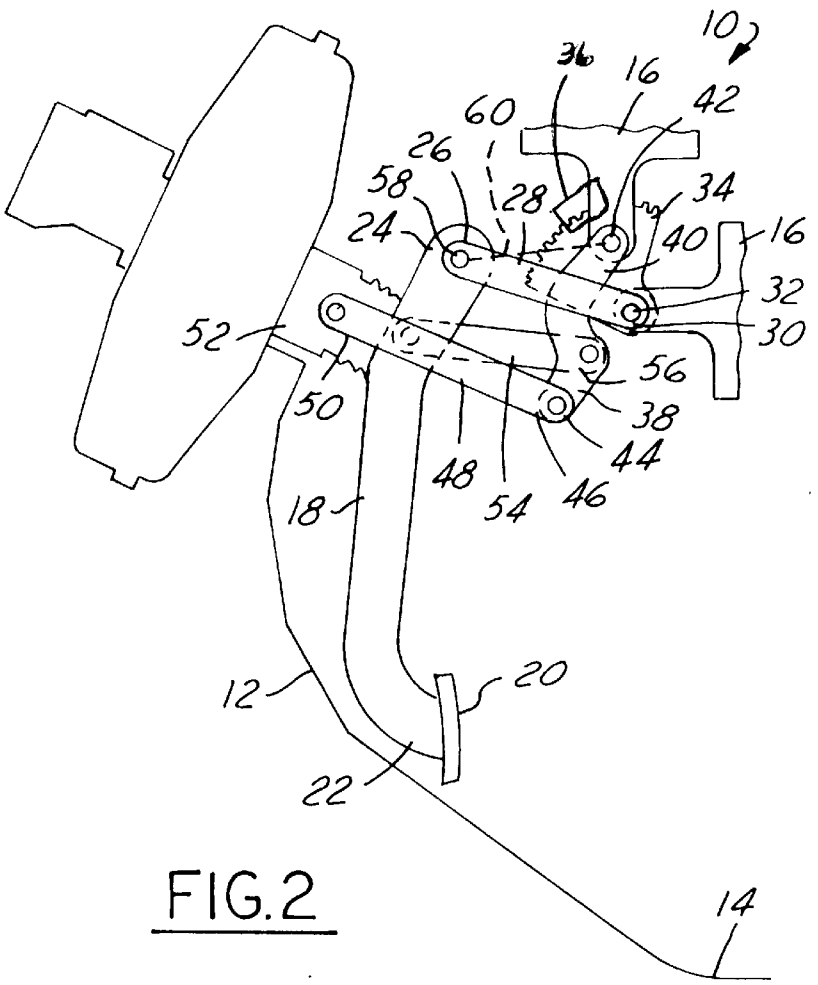
FIG. 2 is a side elevational view of an adjustable pedal mechanism for a motor vehicle constructed in accordance with the present invention.

FIG. 2 illustrates the pedal in a fully applied position. The adjuster link 28, the virtual ground point 58 and the adjustable ground link 60 do not move during operation of the pedal. As the pedal is pressed toward the floor by the operator, the pedal lever 18 pivots about the virtual ground point 58. This causes the drag link 54 to pull the bell crank 38 along with the motion of the pedal lever. As the bell crank pivots about the second ground point 42, the second end 44 of the bell crank forces the push rod 48 toward the brake master cylinder, thereby actuating the brake master cylinder.

Figure 5:
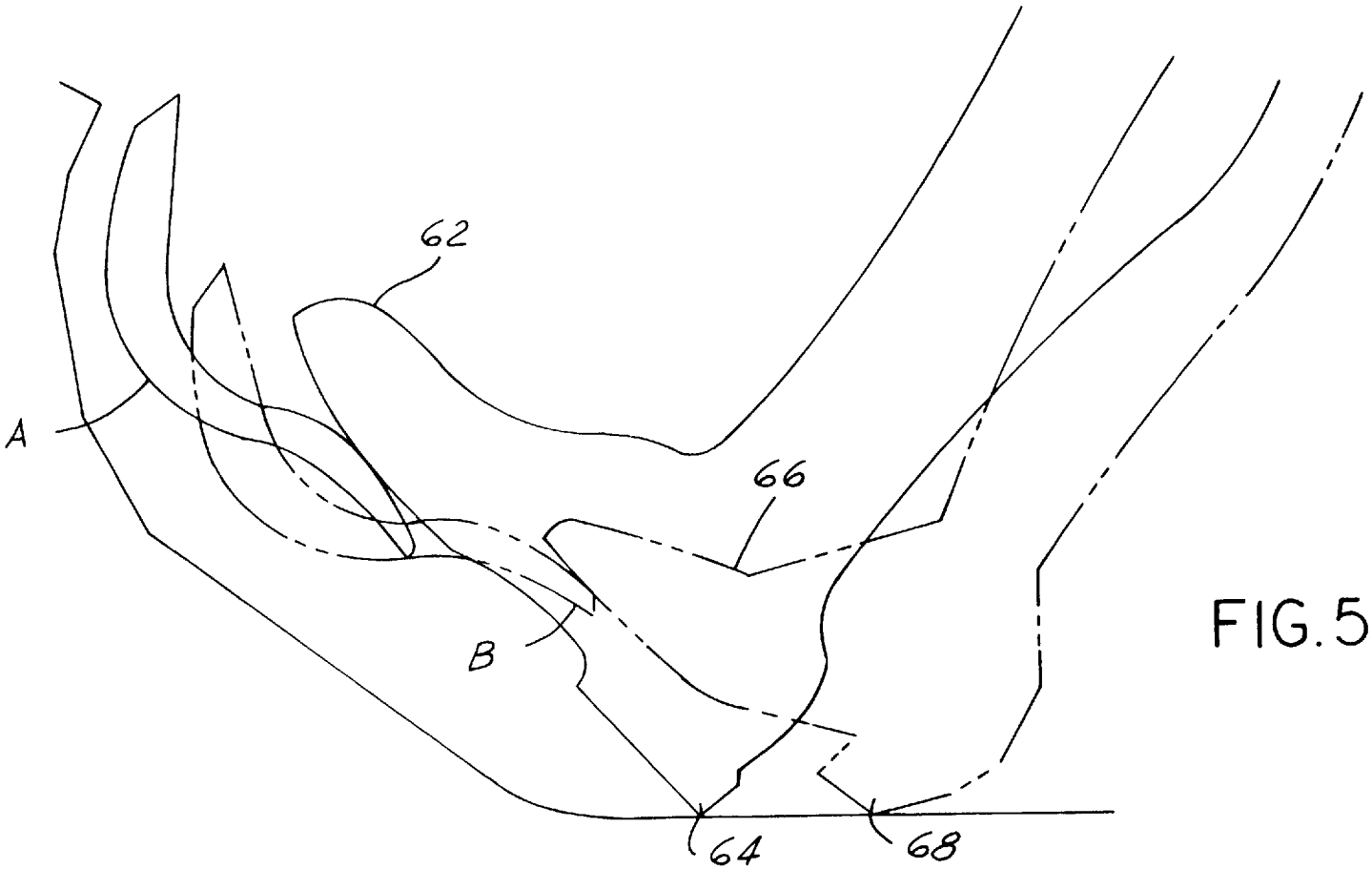
FIG. 5 is a side elevational view showing a ninety-fifth percentile operator's foot relative to a correspondingly adjusted pedal and a two and a half percentile operator's foot relative to a correspondingly adjusted pedal as provided by the by the present invention.

Referring now to FIG. 5, operation of the pedal lever previously described is represented by the large foot outline 62. It can be seen that the heel 64 of the operator's foot rests on a portion of the floor member 14. It is well known that to prevent fatigue and discomfort, it is important to allow the operator's heel 64 to rest on the floor member 14 while maintaining contact with the pad 20 of the brake lever. Additionally, the operator should be able to press the pedal through its travel without lifting the heel from the floor member.

Referring now to the smaller foot 66, it should be apparent that for this operator to apply the pedal with it in the forward most position (shown as A) the operator would either have to lift the heel 68 from the floor, or move the seat considerably forward. Moving the seat forward is undesirable for a variety of reasons, including the sharper angles that the operators leg and foot must form to operate the pedal. For these reasons and others, the present invention permits the operator to adjust the pedal lever rearward in such a manner that an operator with shorter legs can maintain heel contact while pressing the pedal lever through its range of motion.

Figure 4:
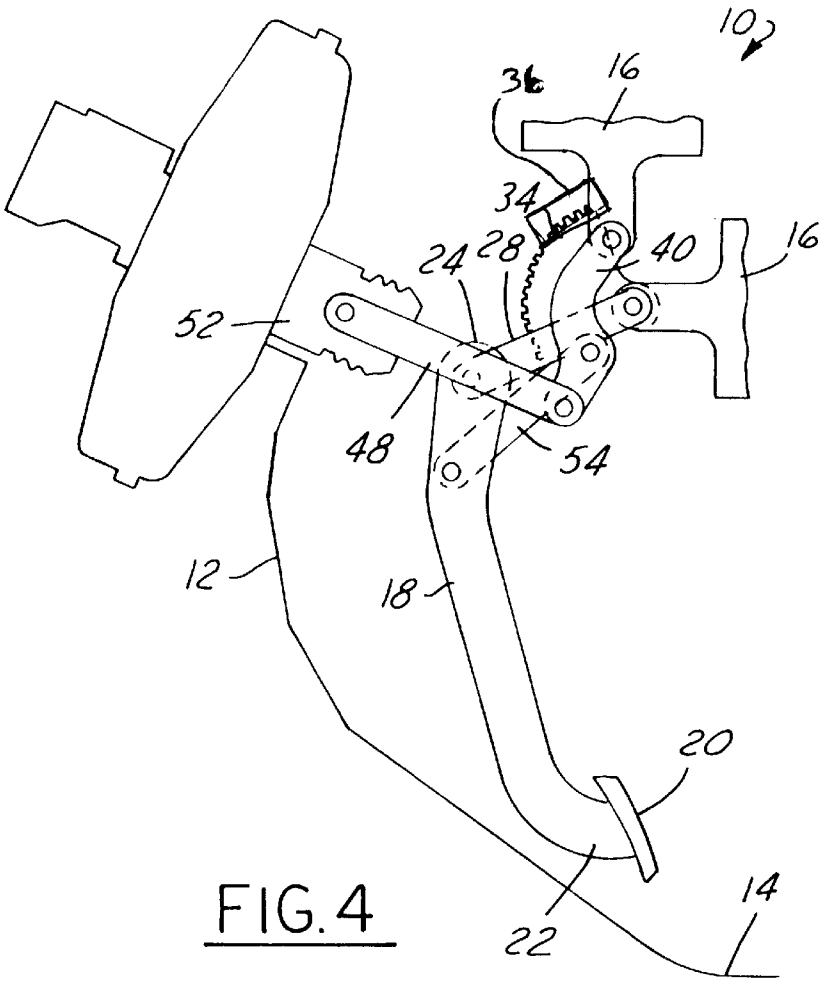
FIG. 4 is a side elevational view of an adjustable pedal mechanism for a motor vehicle constructed in accordance with the present invention.
Figure 3:
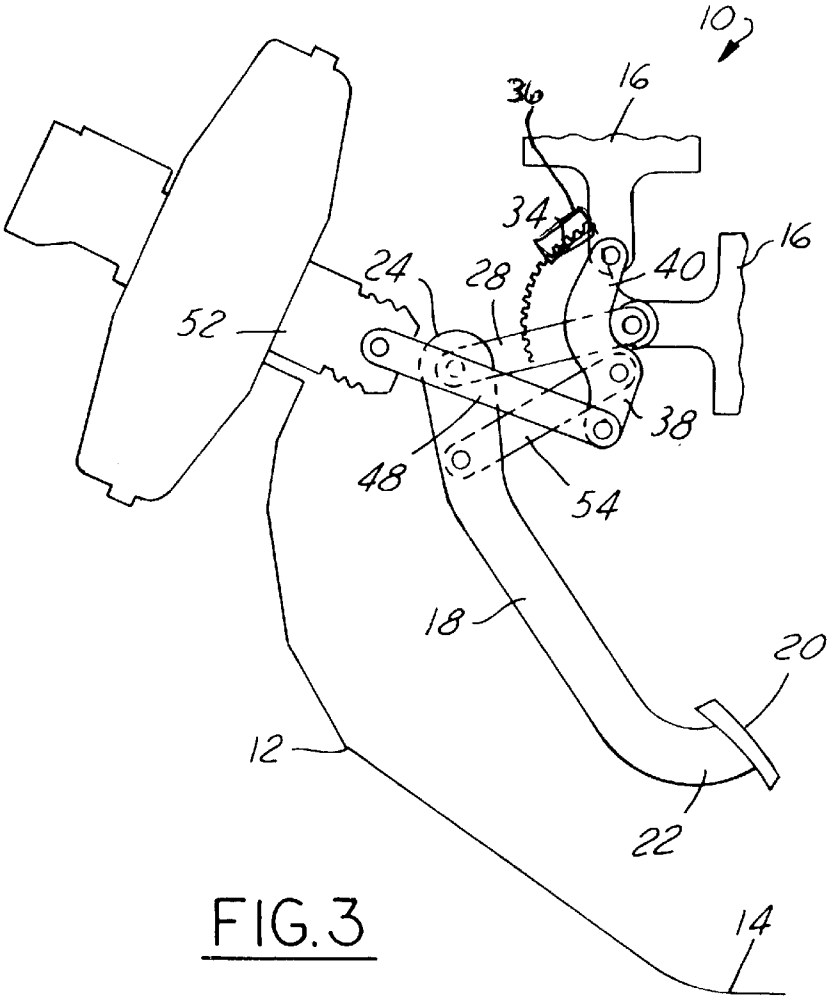
FIG. 3 is a side elevational view of an adjustable pedal mechanism for a motor vehicle constructed in accordance with the present invention.

FIGS. 3 and 4 illustrate the adjustable pedal assembly adjusted to its second or rearward position in the released and applied positions, respectively. The adjustment is accomplished by manipulating the sector gear 34 so as to rotate the adjuster link 28 downward about the first ground point 32. This drives the virtual ground point 58 downward, which in turn repositions the adjustable ground link 60. The parallelogram is accordingly adjusted. From this it can be seen that the lengths of the members of the parallelogram must be chosen carefully to provide consistent motion ratios for all adjusted positions of the adjuster link. This is important to provide consistent effort and displacement properties for the actuation of the pedal activated device, such as the brake master cylinder.

Various modifications and variations will no doubt occur to those skilled in the art to which this invention pertains. Those and all other variations which basically rely on the teachings by which this disclosure has advanced the art are properly considered within the scope of this invention as defined by the appended claims.

I claim:

1. An adjustable pedal apparatus for actuating a device within a vehicle, said adjustable pedal apparatus comprising:

a pedal lever having a first end;

an adjuster link having a first end pivotally connected to a second end of said pedal lever and a second end pivotally connected to a first ground point;

a bell crank having a first end pivotally connected to a second ground point;

a push rod having a second end attached to the device and a first end pivotally attached to a second end of said bell crank; and a drag link having a first end pivotally connected to said bell crank between said first and second ends of said bell crank and a second end pivotally connected to said pedal lever between said first and second ends of said pedal lever;

wherein said first end of said adjuster link and said second end of said pedal lever form a virtual ground point so as to form an adjustable ground link with said second ground point, such that adjustment of said adjuster link relative to said first ground point between a first position and a second position adjusts said first end of said pedal lever between corresponding first and second pedal positions.

2. An adjustable pedal apparatus according to claim 1, wherein said adjustable ground link in combination with said pedal lever, said drag link, said bell crank form a parallelogram for translating a displacement and force applied to said first end of said pedal lever to said second end of said push rod.

3. An adjustable pedal apparatus according to claim 1, further comprising adjuster means connected to said adjuster link for rotating said adjuster link relative to said first ground point between said first position and said second position and thereafter preventing further rotation of said adjuster link.

4. An adjustable pedal apparatus according to claim 3, wherein said adjuster means comprises a sector gear attached to said adjuster link adjacent to said first end of said adjuster link and a worm gear for meshingly engaging said sector gear.

5. An adjustable pedal apparatus for actuating a device within a vehicle, said adjustable pedal apparatus comprising:

a pedal lever having a pad disposed on a first end;

an adjuster link having a first end pivotally connected to a second end of said pedal lever and a second end pivotally connected to a first ground point;

adjuster means for rotating said adjuster link relative to said first ground point between a first position and a second position;

a bell crank having a first end pivotally connected to a second ground point;

a push rod having a second end attached to the device and a first end pivotally attached to a second end of said bell crank; and a drag link having a first end pivotally connected to said bell crank between said first and second ends of said bell crank and a second end pivotally connected to said pedal lever between said first and second ends of said pedal lever;

wherein said first end of said adjuster link and said second end of said pedal lever form a virtual ground point so as to form an adjustable ground link with said second ground point and thereby create a parallelogram with said pedal lever, said drag link, said bell crank for translating a displacement and force applied to said first end of said pedal lever to said second end of said push rod.

6. An adjustable pedal apparatus according to claim 5, wherein said adjuster means comprises a sector gear attached to said adjuster link adjacent to said first end of said adjuster link and a worm gear for meshingly engaging said sector gear.

7. An adjustable pedal apparatus for actuating a brake master cylinder within a vehicle, said adjustable pedal apparatus comprising:

a pedal lever having a pad disposed on a first end;

an adjuster link having a first end pivotally connected to a second end of said pedal lever and a second end pivotally connected to a first ground point;

a sector gear attached to said adjuster link adjacent to said first end of said adjuster link;

a worm gear for meshingly engaging said sector gear and rotating said adjuster link relative to said first ground point between a first position and a second position;

a bell crank having a first end pivotally connected to a second ground point;

a push rod having a second end attached to the brake master cylinder and a first end pivotally attached to a second end of said bell crank; and a drag link having a first end pivotally connected to said bell crank between said first and second ends of said bell crank and a second end pivotally connected to said pedal lever between said first and second ends of said pedal lever;

wherein said first end of said adjuster link and said second end of said pedal lever form a virtual ground point so as to form an adjustable ground link with said second ground point and thereby create an adjustable parallelogram with said pedal lever, said drag link, said bell crank for translating a displacement and force applied to said first end of said pedal lever to said second end of said push rod.

* * * * *